United States Patent [19]

Beck

[11] 3,930,460

[45] Jan. 6, 1976

[54] WATER SKI TOW ROPE

[76] Inventor: Thomas J. Beck, 11908 W. Ohio Ave., Milwaukee, Wis. 53227

[22] Filed: Oct. 29, 1974

[21] Appl. No.: 518,492

[52] U.S. Cl. ..... 115/6.1

[51] Int. Cl.[2] ..... B63B 21/56

[58] Field of Search..... 115/6.1, 70; 114/235 WS; 24/73 AP, 73 PB; 16/110 R; 294/74; 156/86

[56] References Cited

UNITED STATES PATENTS

| | | | |
|---|---|---|---|
| 3,196,825 | 7/1965 | Spurlock | 115/6.1 |
| 3,537,418 | 11/1970 | Brownson | 115/6.1 |
| 3,582,457 | 6/1971 | Barthell | 156/86 |
| 3,695,210 | 10/1972 | Stein | 115/6.1 |
| 3,714,316 | 1/1973 | Angeloff | 156/86 |

*Primary Examiner*—Trygve M. Blix
*Assistant Examiner*—Gregory W. O'Connor

[57] ABSTRACT

An arrangement for securing a braided rope to the ski tow rope handle by passing the rope through a transverse hole in the handle, passing the rope around the periphery of the handle and then inserting a portion of the end of the rope into the braided rope so that it passes back through the transverse hole in the handle. The braided rope acts in the manner of the well known Chinese finger, in that the higher the stress placed on the rope, the tighter it grasps the end of the rope that is inserted into it to prevent its detachment from the handle. To insure that the braided rope always retains some grip on the portion of rope inserted into it and to provide protection for the hands of the skier, a rubber sleeve is placed over the rope directly adjacent to the handle. In order to prevent the rubber sleeve from being displaced, a length of heat shrinkable tubing is applied to the rubber tubing and extends beyond the tubing to overlap onto the braided rope itself. The inner surface of this heat shrinkable tubing is provided with a heat sensitive adhesive to increase its hold on the rubber sleeve and the braided rope.

8 Claims, 5 Drawing Figures

WATER SKI TOW ROPE

BACKGROUND OF THE INVENTION

The fastening of the rope portion of a water ski tow rope to the handle of the tow rope presents a particular problem because it is imperative that the rope does not detach from the handle during use or injury may result. Moreover, the fastening to the handle must be accomplished in such a manner so as not to interfere with the hands of the skier as he grips the handle. The area around the handle must be relatively smooth to avoid chafing the hands of the skier. It is also desirable to stiffen the rope directly adjacent to the handle to prevent it from accidentally winding about the fingers of the skier.

For example U.S. Pat. No. 3,092,068 illustrates a hand grip for a ski tow rope in which a knot is tied on the end of the rope and the knot is held within the inner diameter of the tubular handle. This manner of tieing a rope to the handle is not entirely foolproof, particularly if the knot is carelessly tied and the rope becomes slippery when wet. Furthermore no protection is provided for the hands of the skier against chafing from the rope or from winding about the finger of the skier.

SUMMARY OF THE INVENTION

According to the present invention, a braided rope is used for towing the skier behind a boat. The handle which the skier grips is provided with a transverse hole at each end, the two holes being parallel to each other. A strand of the braided rope is passed through each of the transverse holes, is then extended about the periphery of the handle. At the transverse hole the braids of one wall of the rope are separated to enable the extending end of the rope pass through the opening and into the core of the braided rope so that a portion of the end of the rope extends into the central core of the same rope of which it is a part.

With this arrangement the braided rope tightens diametrically whenever any longitudinal stress is placed upon it to firmly grip the end portion of the rope within it to prevent its escape. The greater the stress, the tighter the grip on the rope. Thus, the braided rope is analogous to the well known Chinese finger which tightens its grip on a person's finger whenever an axial force is applied to pull it off of the finger.

when the stress is removed from the rope and it is fully relaxed the braided rope can expand an appreciable amount to completely release its hold on the end of the rope within it. In order to avoid such complete relaxation and always maintain some gripping on the rope inside it, a rubber sleeve is placed on the braided rope directly adjacent to the handle. This rubber sleeve serves the twofold purpose of preventing excessive relaxation of the braided rope so that some grip is always maintained on the end of the rope within the core. The rubber sleeve serves the further purpose of protecting the hands of the skier from chafing on the relatively rough surface of the braided rope when high stresses occur during the water skiing.

It has been found that when a skier is being towed at high speeds behind a boat, the splashing water curls up the ends of the rubber sleeve off of the rope and onto itself. This causes undue wear on the rubber sleeve to render it ineffective after prolonged use. In order to avoid this, the present invention provides for the placement of heat shrinkable tubing on the rubber sleeve and extending over its end onto the braided rope. The interior surface of the heat shrinkable tubing is coated with a heat sensitive adhesion. Therefore, after the heat shrinkable tubing is placed on the rubber sleeve and the adjacent braided rope, heat is applied to it to cause it to shrink onto the rubber sleeve and onto the braided rope. The heat not only causes the tube to shrink but also activates the adhesive so that the adhesive combines with the shrinking to securely fasten the tubing in place. It has been found that this arrangement will withstand all of the forces that are developed during the water skiing operation so that the rubber sleeve is not displaced.

It is therefore a general object of the present invention to provide a novel means of securely fastening the rope to the handle of a water ski tow rope while at the same time providing protection for the hands of the skier against chafing from contact with the rope.

It is also an object of the invention to reduce the flexibility of the tow rope directly adjacent to the handle to minimize the possibility of the rope curling about the finger of the skier and thereby avoid an injury.

It is a further object of the present invention to provide an improved arrangement for securing a rubber sleeve in position on the line of the tow rope to prevent the rubber sleeve from being displaced and worn by the action of the water during a water skiing operation.

DESCRIPTION OF THE PREFERRED EMBODIMENT

Figures 1, 2, 3, 4, 5:
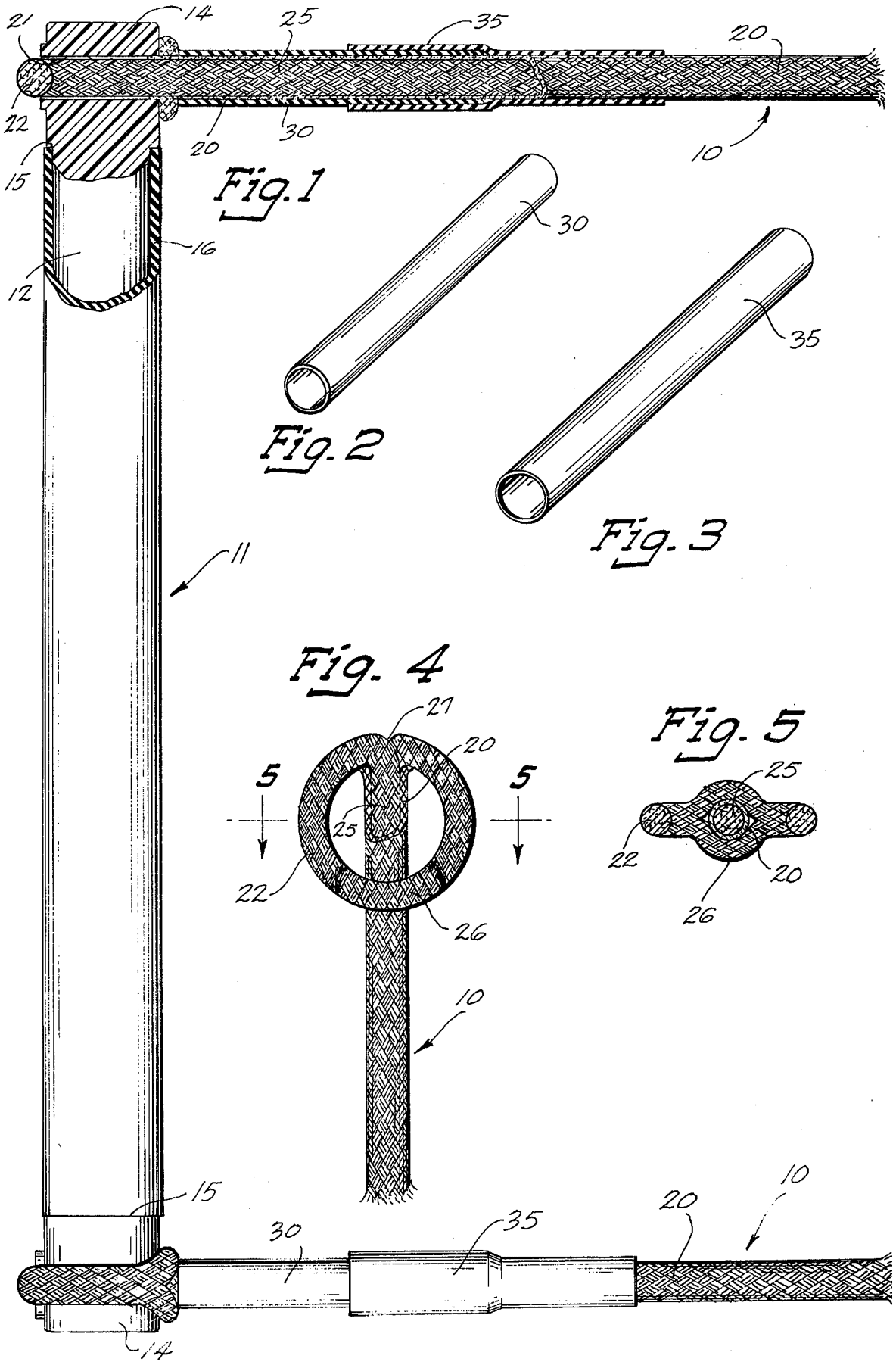
FIG. 1 is a fragmentary view showing the handle of a water ski tow rope with a portion of the two strands of rope extending from the handle, a portion of the rope and handle being broken away to show how the rope is fastened to the handle.
FIG. 2 is a perspective view of a rubber sleeve that is applied over the rope directly adjacent to the handle.
FIG. 3 is a perspective view of a length of heat shrinkable tubing with a heat sensitive adhesive on its inner surface and which is applied over the rubber sleeve shown in FIG. 2 and extends beyond the rubber sleeve onto the adjacent exposed rope.
FIG. 4 is a detail view substantially in elevation with portions broken away to better illustrate the path of the rope about the handle and into its core for securing the rope to the handle.
FIG. 5 is a sectional view taken along the plane represented by the line 5—5 in FIG. 4.

Reference is now made more particularly to the drawing and specifically to FIG. 1 thereof which illustrates a water ski tow rope generally identified by the reference numeral 10 attached to each side of a handle generally identified by the reference numeral 11. In water skiing, the skier grips the handle 11 with both hands and a tow line 10 is attached to each side of the handle 11 to extend therefrom a substantial distance with its opposite end being secured to the boat that is towing the skier about the water.

The present invention is directed to the novel arrangement for attaching the tow rope 10 to the handle 11 and therefore only that portion of the tow rope 10 adjacent to the handle 11 is illustrated in the drawing. The attachment to the boat (not shown) is not a part of the present invention but can be accomplished in any conventional manner.

The handle 11 is formed of an elongated cylinder 12 that may be formed of plastic or other suitable material having enlarged ends 14 to form an annular shoulder 15 at each end of the cylinder 12. Thus, a shoulder 15 is provided at each end of the handle 11 and a relatively soft rubber sleeve 16 is in firm engagement with the cylinder 12 between the two shoulders 15 so that the ends of the sleeve 16 abut the two shoulders 15 to prevent any axial movement of the sleeve 16 and firmly attach it to the cylinder 12. The sleeve 16 provides a high co-efficient of friction to enable the skier to obtain a good grip on the handle 11 and is also spongy and soft so that it is comfortable to hold.

The rope 10 is preferably made of a strong plastic such as nylon that is formed into strips that are braided to form the line 10. The braided plastic actually forms a long tubing with flexible braided walls having a hollow core. The braiding can be forced together axially to in effect shorten the line, but then the diameter of the hollow core is increased substantially. On the other hand, the line can be stretched axially and this causes a reduction in the diameter of the hollow core to the extent that it disappears because the walls of the braided tubing are in contact with each other. This is identical to the well known Chinese finger which is a braided tubing that can be relaxed to be placed on the finger but when tension is placed to pull it off, the tubing contracts about the finger and grips it tightly to prevent its removal. The same principle is applied in attaching the tow rope 10 to the handle 11.

Thus, the tow line 10 is formed of the braided cylindrical wall 20 and in order to secure the rope 10 to the handle 11 the rope 10 is passed through a bore 21 that is formed transversely at each end of the handle 11 for receiving the two ropes. Inasmuch as both ropes 10 are attached to the handle 11 in exactly the same manner, reference will be made to only one of the structures and it is to be understood that the same description likewise applies for attaching the other rope to the handle 11. A substantial portion of the line 10 is passed through the bore 21 and it is then looped about the periphery of the enlarged end 14 to form an annular loop 22. An extending end 25 of the rope 10 is then passed through the rope 10 into its core as clearly shown in the top portion of FIG. 1. As a result, when tension is placed upon the rope 10 its braided wall 20 contracts about the extending end 25 within its core to firmly grip the extending end 25 and prevent its escape.

The actual path of the rope 10 is best shown in FIGS. 4 and 5 where the cylinder 12 of the handle 11 has been eliminated and only the rope 10 is illustrated. As there shown, the braiding of the wall 20 has been separated at the point identified by the reference numeral 26 so that the tow line 10 passes through the separation 26 upwardly through the bore 21 of the handle 11 and is then looped clockwise as shown in FIG. 4 to form the loop 22. The braiding is again separated at the portion identified by the reference numeral 27 in FIG. 4 and the extending end 25 extends from the loop 22 and is passed through the separation 27 into the hollow core of the rope 10 so that the extending end 25 occupies the central bore formed by the cylindrical braided walls 20. The length of the extending end 25 within the braided wall 20 of the rope 10 is not critical but it has been found that seven to eight inches of length is fully adequate.

The secure attachment of the tow rope 10 to the handle 11 in this manner can be readily understood but in order to prevent any possibility of the extending end 25 from escaping from within the interior of the braided wall 20 when the line is relaxed, a rubber sleeve 30 is tightly fitted over the rope 20 at the portion immediately adjacent the handle 11 and extending outwardly therefrom to encompass that portion of the tow rope 10 which includes the extending end 25.

The sleeve 30 serves two very important functions. First, it tightly engages the braided wall 20 of the rope 10 to prevent its expansion when the line is relaxed and thereby maintains tight engagement with the extending end 25 that is disposed within the braided wall 20. In addition, the braided rope 20 is rather abrasive and the rubber sleeve 30 protects the hands of the skier when the hands rub into engagement with the tow rope 10 while gripping the handle 11.

As clearly shown in FIG. 1, the rubber sleeve 30 has one end in abutment with the enlarged end 14 of the handle 11 but the opposite end would normally be exposed upon the periphery of the rope 10. It has been found that during a skiing operation, the water applies substantial forces to the exposed elastic end of the rubber sleeve 30 causing it to curl and fray so that it rapidly wears. Replacing such rubber sleeve 30 on an assembled tow rope is cumbersome and difficult and it has been found that this can be readily avoided by applying a length of heat shrinkable tubing 35 to overlap the exposed end of the rubber sleeve 30. Thus, a perspective view of the heat shrinkable tubing 35 is illustrated in FIG. 3 showing that it is of uniform diameter when applied to the rope 10. Approximately one half of this heat shrinkable tubing 35 is placed over the extending end of the sleeve 30 and the other half overlies the exposed rope 10. Heat is then applied to the tubing 35 to cause it to tightly shrink about the rubber sleeve 30 as well as about the rope 10 as shown in FIG. 1.

Shrinkable tubing of the type suitable for the present invention is commercially available, as for example, ALPHLEX FIT shrinkable tubing produces. Such shrinkable tubing is formed of a polymer such as polyolefin or polyvinylchloride. In a heated state, the tubing is expanded by mechanical means. If the mechanical form is removed while the tubing is still heated, the tubing would return to its original diameter. Instead, the expanded tubing, immediately following heat treatment, is quenched while still in its enlarged state. As a result of this process, the polymer crystalizes and remains stable in the enlarged state until in actual usage it is reheated, releasing the crystalization and returning the material to its original diameter.

Thus, a diameter of heat shrinkable tubing 35 suitable to pass over the rubber sleeve 30 is provided and heat is applied, as for example, by a hot air gun. However, even the flame of a match will cause the tubing 35 to shrink and other methods of applying the heat can be employed. Once the heat is employed, the tubing 35 shrinks tightly about both the rubber sleeve 30 and the rope 10.

To provide an additional resistance to slippage, the interior of the shrinkable tubing 35 is coated with a heat sensitive adhesive so that when the heat is applied to shrink the tubing 35, the adhesive is likewise activated and it tightly grips the tubing 35 about the periphery of the rubber sleeve 30 and the rope 10. This length of heat shrinkable tubing 35 functioning in combination with the adhesive applied to its interior firmly grips the rope 10 as well as the sleeve 30 and this withstands the forces of the water during the skiing operation and prevents the fraying of the rubber sleeve 30.

The rubber sleeve 30 and the heat shrinkable tubing 35 directly adjacent to the handle 11 of the tow rope 10 serve the further purpose of appreciably reducing the flexibility of the rope directly adjacent to the handle 11. This practically eliminates the possibility of the rope winding about a finger or part of the hand of the skier which could cause an injury if it happened while water skiing.

From the foregoing detailed description of the illustrative embodiment of the invention set forth herein it will be apparent that there has been provided an approved water ski tow rope with an improved arrangement for firmly securing the end of the tow rope to the handle which is gripped by the skier.

Although the illustrative embodiment of the invention has been described in considerable detail for the purpose of disclosing a practical operative structure whereby the invention may be practised advantageously, it is to be understood that the particular water ski tow rope is intended to be illustrative only and that the various novel characteristics of the invention may be incorporated in other structural forms without departing from the spirit and scope of the invention as defined in the subjoined claims.

The principles of this invention having now been fully explained in connection with the foregoing description, I hereby claim as my invention:

1. In a water ski tow rope having a handle that is gripped by the skier and at least one tow line attached to the handle and extending therefrom for securement to the boat which is towing the skier, said tow line being formed of a braided material that is one continuous braided tubular wall having a central hollow core and one end of the tow line is passed into the hollow core of the braided two line to form a loop on the end of the tow line for attachment to said handle; an elastic sleeve gripping said line directly adjacent to said handle and extending therefrom a distance along said rope to protect the skiers hands from chafing and means overlapping said sleeve and said line to secure said elastic sleeve to said line against displacement by water pressures developed during skiing.

2. A water ski tow rope according to claim 1 wherein said securing means is a length of heat shrinkable tubing that is shrunk onto said elastic sleeve and the rope in overlapping relationship.

3. A water ski tow rope according to claim 2 including a heat sensitive adhesive coated on the interior surface of said heat shrinkable tubing so that it is activated by the heat that is applied to said tubing to shrink it to thereby create a strong bond between said heat shrinkable tubing and the elastic sleeve and rope with which it is in contact.

4. A water ski rope according to claim 1 wherein said securing means is a plastic tubing that encompasses the end of said elastic sleeve and a portion of the tow line adjacent to it so that said plastic tubing overlaps said elastic sleeve and a portion of the tow line; and including an adhesive between said plastic tubing and the elastic sleeve and the tow line with which it is in contact to form a tight bond therebetween.

5. A water ski tow rope according to claim 1 wherein said tow line passes through a transverse hole in the handle and then about the periphery of the handle with an extending end of the tow line passing back through the transverse hole in the handle and through the hollow core of the braided tow line so that the braided wall of the tow line encompasses the extending end of the same tow line whereby as increasing longitudinal tension is applied to the tow line the braided wall of the tow line contracts diametrically to increasingly tighten about the extending end of the line within said braided wall to prevent the escape of the extending end; said elastic sleeve gripping said braided tow line directly adjacent to the handle to prevent excess relaxation of the braided tow line and thereby prevent inadvertent displacement of said extending end from the interior of the braided tow line, said elastic sleeve also protecting the hands of the skier from chafing due to contact with the tow line.

6. A water ski tow rope according to claim 5 wherein said securing means is a length of heat shrinkable tubing that is shrunk onto said elastic sleeve and onto the rope in overlapping relationship.

7. A water ski tow rope according to claim 6 including a heat sensitive adhesive coated on the interior surface of said heat shrinkable tubing so that it is activated by the heat that is applied to said tubing to shrink it and thereby creates a strong bond between said heat shrinkable tubing and the elastic sleeve and rope with which it is in contact.

8. A water ski rope according to claim 5 wherein said securing means is a plastic tubing that encompasses the end of said elastic sleeve and a portion of the line extending from said sleeve so that said plastic tubing overlaps said elastic sleeve and a portion of the tow line; and including an adhesive between said plastic tubing and the elastic sleeve and the tow line with which it is in contact to form a tight bond therebetween.

* * * * *